US005967271A

United States Patent [19]

Wömpner et al.

[11] Patent Number: 5,967,271

[45] Date of Patent: Oct. 19, 1999

[54] COMPOSITE SECTION HAVING A SUPPORTING BASE OF LIGHT-WEIGHT METAL AND AT LEAST ONE METALLICALLY-JOINED, PROFILED STRIP AND PROCESS FOR MANUFACTURING A COMPOSITE SECTION

[75] Inventors: Diethelm Wömpner, Bodman-Ludwigshafen; Joachim Glück, Schenkenzell; Uwe Bock, Singen, all of Germany

[73] Assignee: Alusuisse Technology & Management Ltd., Switzerland

[21] Appl. No.: 09/152,538

[22] Filed: Sep. 18, 1998

Related U.S. Application Data

[62] Division of application No. 08/872,025, Jun. 10, 1997, which is a continuation of application No. 08/400,719, Mar. 8, 1995, abandoned.

[30] Foreign Application Priority Data

Mar. 28, 1994 [DE] Germany ..... 4410688
Jun. 28, 1994 [DE] Germany ..... 4422533

[51] Int. Cl.[6] ..... B60M 1/00

[52] U.S. Cl. ..... 191/22 DM; 191/29 DM

[58] Field of Search ..... 191/22 R, 22 DM, 191/29 DM, 29 R, 22 C, 32; 428/609; 238/143, 144, 145, 146, 147, 148; 174/126.2; 72/253.1, 258

[56] References Cited

U.S. PATENT DOCUMENTS

| | | | |
|---|---|---|---|
| 1,042,545 | 10/1912 | Gamwell | 238/143 |
| 2,490,548 | 12/1949 | Shultz | 428/609 |
| 5,267,634 | 12/1993 | Bruning | 191/22 DM |

FOREIGN PATENT DOCUMENTS

| | | | |
|---|---|---|---|
| 45227 | 3/1984 | Japan | 191/22 DM |
| 207235 | 9/1986 | Japan | 191/290 DM |
| 34441 | 2/1990 | Japan | 191/29 DM |

*Primary Examiner*—Mark T. Le
*Attorney, Agent, or Firm*—Bachman & LaPointe, P.C.

[57] ABSTRACT

A composite section (10) features a base (12) of light-weight metallic material as section component and at least one further profiled section component, in particular a profiled strip (18) of another metallic material which is joined metallically as a surface layer to the base section during an extrusion process. Projecting out of the inner-lying face (21) of the profiled strip (18) and directed at the base (12) is at least one projection and/or an additional element (23) which are/is embedded in the base (12). Each additional element (23) may delimit an undercut space which is filled in an interlocking manner by metallic material of the base (12).

8 Claims, 2 Drawing Sheets

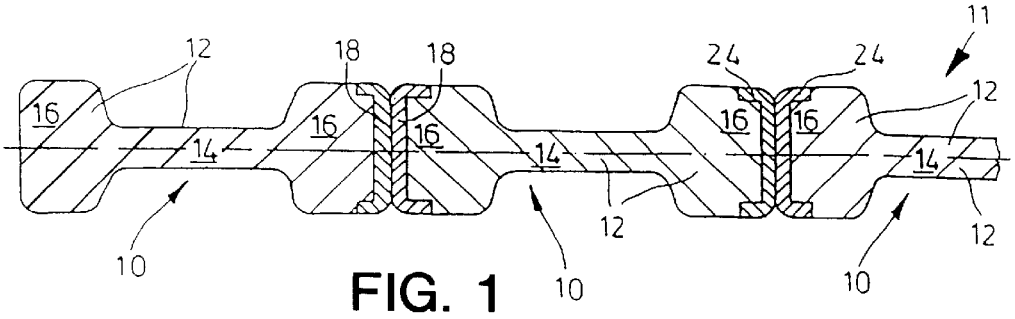
FIG. 1
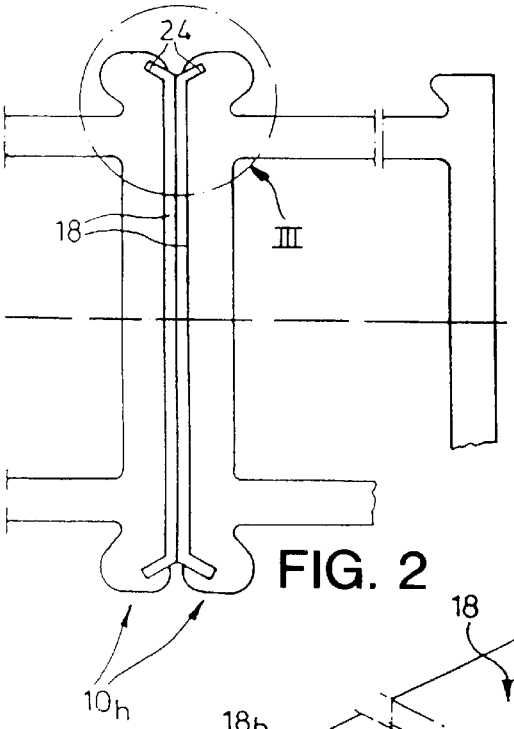
FIG. 2
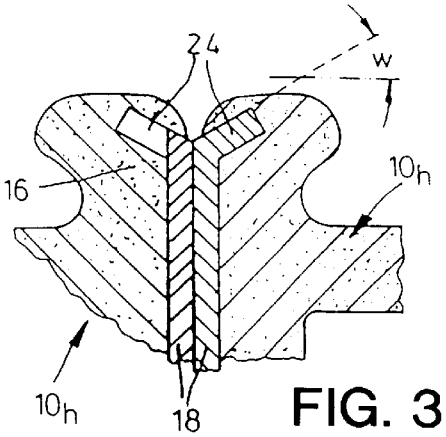
FIG. 3
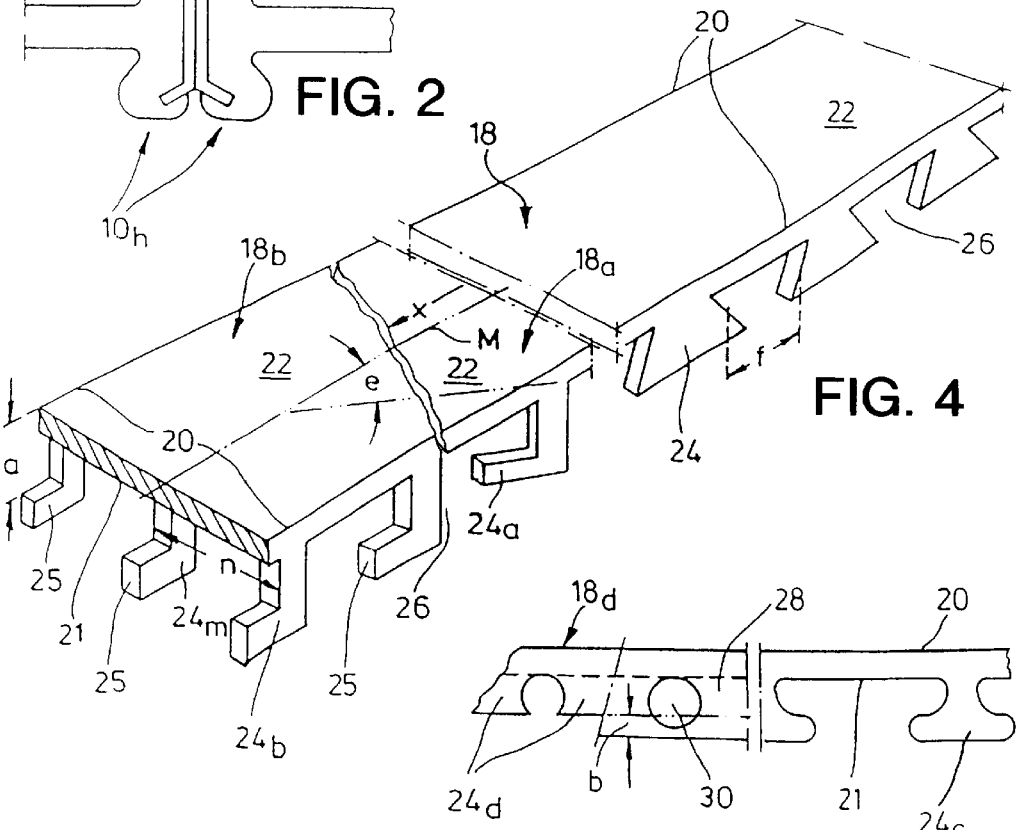
FIG. 4
FIG. 5

COMPOSITE SECTION HAVING A SUPPORTING BASE OF LIGHT-WEIGHT METAL AND AT LEAST ONE METALLICALLY-JOINED, PROFILED STRIP AND PROCESS FOR MANUFACTURING A COMPOSITE SECTION

CROSS-REFERENCE TO RELATED APPLICATIONS

This application is a divisional of U.S. patent application Ser. No. 08/872,025, filed Jun. 10, 1997 which in turn is a continuation of U.S. patent application Ser. No. 08/400,719, filed Mar. 8, 1995, now abandoned.

BACKGROUND OF THE INVENTION

The invention relates to a composite section having a supporting base of light-weight metal as profiled section component and at least one further profiled section component, in particular a profiled strip of another metal, joined metallically, as a surface layer, to the first mentioned section during an extrusion process. Further, the invention relates to a process for manufacturing a composite section having two profiled components.

Known from the German patent document DE-PS 24 32 541 of the inventor is a process for manufacturing conductor rails having a supporting base section and at least one super-imposed layer of profiled strip of another metal forming at least a part of the surface of the support base. During the extrusion process the support base is created by pressing a billet through the shape-forming cross-section of a die; at the same time the profiled strip runs through the die opening parallel to the longitudinal axis of the die or shape-forming cross-section. The object of the above-mentioned viz., to provide adequate combination of the profiled strip to the support base also when employing non-pre-plated strips and, in addition, to enable particularly economical manufacture a is achieved by way of the prior invention in that at least two composite sections are manufactured simultaneously whereby the areas of the support sections to be fitted with the surface layers face each other and the profiled strips, in pairs lying one on top of the other, are introduced through the shape-forming cross-section of the die.

In knowledge of this state of the art the object of the present invention is to improve further the connection between the support section and the profiled strip, at the same time preserving the possibilities for economic manufacture.

SUMMARY OF THE INVENTION

That object is achieved by way of the present invention as described herein.

In accordance with the invention the profiled strip features, at least on one long edge of its inner-lying face directed towards the support section, projections that are spaced apart and project downwards and are embedded in the support base. At the same time the projections should delimit undercut spaces that are filled in an interlocking manner by metallic material from the support base.

Also within the scope of the invention is that at least one additional element is attached to the inner face of the profiled strip and is embedded in the support base; the additional elements should preferably be welded onto the profiled strip and, if desired, delimit an undercut space, that,—as mentioned above,—is filled in an interlocking manner by metallic material of the base.

On the side of the profiled strip facing the base (joint side), therefore, further sections, strips, transversely stamped sections and strips, bolts or anchor-shaped projections—preferably of stainless steel,—are securely joined to the profiled strip by resistance roll seam welding, stud welding or another continuous or spot welding method e.g. non-welded joining such as penetration methods, stamping, indentation-interlocking, or adhesive bonding. As a result, after extrusion the steel strip is joined not only by means of metallic bonding but also by mechanical means due to force and interlocking with the base.

Consequently a permanent joint between the two profiled components is achieved with double security viz., by means of the metallic bond between the light alloy e.g. base section and the profiled strip, and by the interlocking action at the recesses. This form of joining remains intact even if the metallic bond should be incomplete or weakened in some areas.

It has also been found favorable to arrange at least some of the projections at an angle to the longitudinal axis of the profiled strip, preferably inclined inwards in the extrusion direction; this has the effect of intensifying the interlocking action.

According to another feature of the invention, the joint is strengthened by at least one series of projections projecting down from the inner face of the profiled strip between its longitudinal edges at a distance from the same.

Usefully, the projections may be inclined with respect to the inner-lying face of the profiled strip, if desired resulting in two different directions of inclination.

A further version of the invention is such that an additional element is provided on the profiled strip and namely in the form of at least one wire attached to and running parallel to its longitudinal edges, preferably a round wire welded to the central axis of the profiled strip. Or, at least one channel-shaped section is attached to the profiled strip in such a way that its sidewall flanges are directed away from the inner-lying surface of the profiled strip or the underside of the steel strip.

Furthermore, according to the invention these flanges may run at an angle to the inner-lying face, in particular outwards i.e. away from the longitudinal edges of the profiles strip.

It has proved favorable to provide the flanges with recesses, in particular peripheral recesses that are delimited by sections of the flanges.

A further version features an anchorage means in the form of bolts welded to the steel strip.

A process according to the invention for manufacturing the composite section is such that projections projecting out of the plane of the strip-like profiled components are embedded in the light metal matrix and are joined by interlocking with the matrix. The projections projecting out of the plane of the strip-like profiled component(s) are preferably bent out of their plane on entering the die opening.

Of particular importance in this connection is the measure of introducing at least two separate strip-like profiled components, face-to-face one on top of the other, into the die opening, in the process of which the outer facing surfaces of the strip-like profiled components join intimately to the other section components forming the matrix while the other, protected neighboring faces, of the strip-like profiled components remain separate.

A further process according to the invention for manufacturing the composite section is such that additional elements are welded to the strip-like profiled components and the additional elements projecting out of the plane of the strip-like profiled components are embedded and joined in an interlocking manner with it.

In all, the described solution leads to a composite section featuring permanent, intimate bonding of the profiled components and thus to a complete solution of the problem facing the inventor.

BRIEF DESCRIPTION OF THE DRAWINGS

Further advantages, features and advantages of the invention are revealed by way of the following description of preferred exemplified embodiments and with the aid of the drawing comprising the following schematic representations:

FIG. 1: a cross-section through a multi-component composite section;

FIG. 2: a partial end-view of a pair of abutting composite sections each featuring two composite partners;

FIG. 3: an enlarged cross-section through a part of the composite sections in FIG. 2;

FIG. 4: a perspective view of a composite partner of the composite section, showing three different examples thereof;

FIG. 5: a side-view of a component of the composite section, showing two different examples thereof;

DETAILED DESCRIPTION OF PREFERRED EMBODIMENTS

Figure 6:
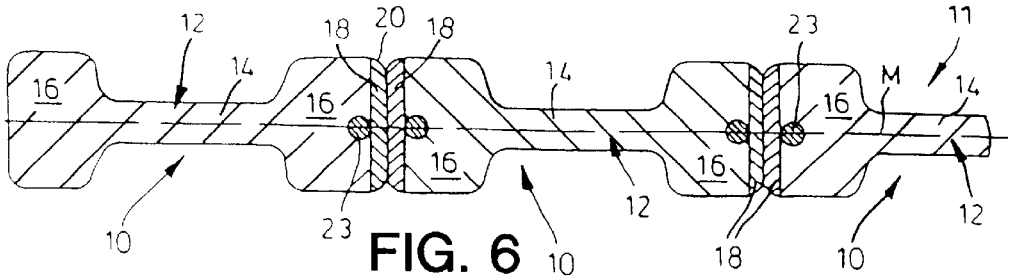
FIG. 6: a cross-section as in FIG. 1 through a further multi-component composite section made up of a plurality of profiled components.
Figure 7:
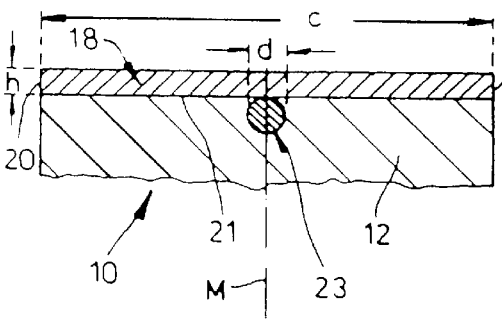
FIG. 7: an enlarged view of part of FIG. 6.

Employing an extrusion press, which for reasons of clarity is not shown in the drawing, a plurality of composite sections 10 is produced as parts of a so called multi-component composite 11, which in one version comprises a rail-like support base 12 with head pieces 16 at both ends of a strut 14 and at least one profiled strip 18 which is joined to one of the head pieces 16 during the extrusion process. The profiled strip 18 is made of iron or non-ferrous metal, the support base of an aluminum alloy.

During the extrusion process the profiled strip 18 is fed into a shape-giving die opening or shaping cross-section of the extrusion press and passes through this together with the matrix material of aluminum alloy flowing from a hot extrusion billet; in the course of that process, and as a result of high pressure, both metallic materials are joined together at the areas of contact. For reasons of economy, and in order to prevent the edges of the essentially ready-shaped profiled strip 18 damaging the shape-giving contour of the extrusion press, the profiled strips 18 of the abutting composites 10 lie one on top of the other.

The harder partner i.e. the profiled strip 18, is provided at its longitudinal edges with pre-shaped projections 24, especially recognizable in FIG. 4, that project down from side of the profiled strip 18 facing the base 12 and are spaced on average a distance f apart, thus delimiting undercut recesses 26.

FIG. 3 shows an enlarged view of the pair of hollow sections $\mathbf{10}_h$ with profiled strip surfacing shown in FIG. 2. From this it can be seen that the projections 24 lie at an angle w outwards and that the projections 24 of both facing strips 18 as seen in end view may be displaced with respect to one another. In a version shown in FIG. 4, middle, the projections $\mathbf{24}_a$ standing at a right angle to the inner face 21 of the profiled strip 18 run at an angle e to the longitudinal axis M of the composite 10.

The inclined or perpendicular position of the projections 24, $\mathbf{24}_a$ is produced either before the profiled strips are introduced into the extrusion press or by means of a bending facility immediately before entering the shape-giving section of the die.

The three versions of profiled strips 18, 18*a* and 18*b* shown in FIG. 4 exhibit at the longitudinal edges 20 either trapezium-shaped projections 24 or hook-like projections $\mathbf{24}_a$, $\mathbf{24}_b$ with hook-ends 25 running a distance a from the section surface 21. One version exhibits a row of projections $\mathbf{24}_m$ on the inner face 21 along the middle axis M of the composite 10 a distance n from the longitudinal edge (s) 20.

FIG. 5 offers T-shaped projections 24, and $\mathbf{24}_d$ formed by boring openings in the sidewall flanges 28 of a profiled strip 18*d* then removing an edge strip; of height b. As a result of the projections 24, $\mathbf{24}_a$ to $\mathbf{24}_d$, other shapes of projections are conceivable, in addition to the metallic bonding between the two components or component partners 12, and 18, $\mathbf{18}_d$ an interlocking mechanical attachment is achieved during the extrusion process with the support base 12 engaging with these projections 24, 24*a* to 24*d* in the undercut regions, at which stage the aluminum alloy is in a pasty-like condition.

Shown in FIG. 6 is the profiled strip 18 made of a steel strip of width c, or a distance. between the longitudinal edges 20 from each other, here 75 mm and a thickness h of 4.5 mm. The strip, prepared in advance, features a round wire or rod 23 of diameter d of approx. 6 mm which has been welded e.g. by resistance welding to the inner face 21 at the middle axis M of the section facing the support base and is embedded in the aluminum alloy matrix forming the support base 12.

Figure 8:
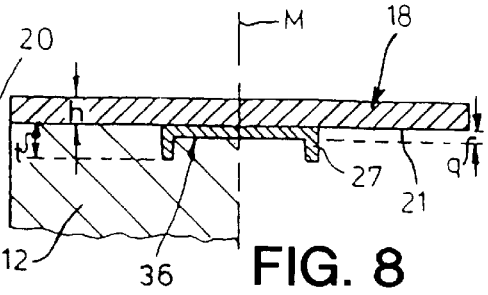
FIGS. 8, 9: another version of that shown in FIG. 7.
Figure 9:
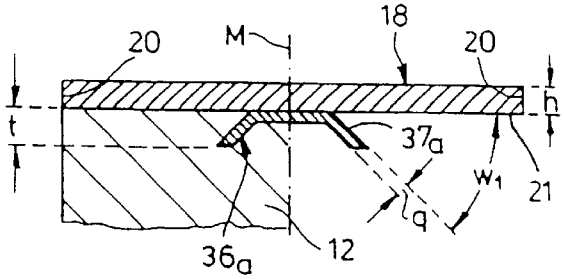

Instead of the round rod 23 the profiled strip 18 in FIGS. 8 and 9 exhibits a channel-shaped section 36, 36*a* made from a steel strip, preferably stainless steel, of q, here 2 mm, that is welded to the inner-face 21. As FIG. 8 shows, at both sides the steel strip features right angled flanges 37 of height t of 6 mm that, in the version $\mathbf{37}_a$ in FIG. 9 are inclined outwards at an angle $w_1$.

Figure 10:
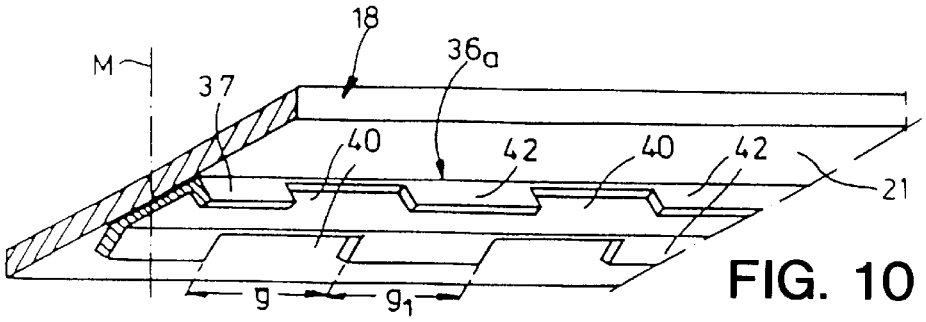
FIG. 10: a perspective view below a version of a profiled component.

Both versions may be employed with channel-shaped sections 36, $\mathbf{36}_a$, having flanges of uniform height t or, as shown in FIG. 10, with recesses 40 of length g in the flanges 37, $\mathbf{37}_a$, the length of remaining turret-shaped flange parts 42 is indicated by $g_1$. Also this transversely stamped channel section 36, $\mathbf{36}_a$ is welded to the steel by resistance roll-seam welding.

Figure 11:
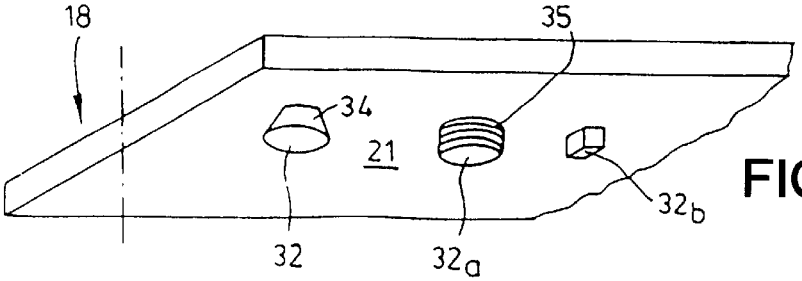
FIG. 11: a perspective view below a further profiled component of the composite section showing three different examples thereof.

FIG. 11 shows bolts 32, $\mathbf{32}_a$, $\mathbf{32}_b$ projecting down from the inner face 21 of the profiled strip 18, said bolts being joined to the profiled strip 18 by stud welding. The left bolt 32, which is the shape of a blunted cone, gives rise to an undercut ring-shaped surface 34. The bolt $\mathbf{32}_a$ in the middle features an external thread 35; bolt $\mathbf{32}_h$ on the right is rectangular in cross-section. These exemplified embodiments of additional elements or bolts 32, $\mathbf{32}_a$, $\mathbf{32}_b$ may be distributed over the inner face 21 as desired.

All of the additional elements 23; 32, $\mathbf{32}_a$, $\mathbf{32}_b$; 36, $\mathbf{36}_a$ described above and shown in FIGS. 6 to 11 are anchored in the light metal matrix of the finished composite section 10.

As a result of these elements 23; 32, 32$_a$, 32$_b$; 36, 36$_a$, other shapes of projections are conceivable, a mechanical joint is achieved between the two section components or section partners 12 and 18 during the extrusion process, this in addition to the metallic bonding,.

The profiled strips are e.g. uncoiled from two reels and pass from the entrance to the extrusion die or heating facility and brushing station, in which the oxide layer on the profiled strips is removed to ensure metallic bonding. After the actual extrusion process, the profiled strips 18 emerge from the tool with the extruded light weight metal as base 12, whereby, as mentioned, they are embedded in the matrix in such a manner that they do not, or only slightly, come into contact with the tool in the region of the die section.

Even in regions where the metallic bond is absent; e.g. due to residual oxide on the profiled strip 18, 18$_d$, the described mechanical, interlocking action insures good connection between the components.

What is claimed is:

1. Extruded composite section which comprises a support base of a light-weight metal as a profiled section component and at least one further profiled section component having longitudinal edges and an inner-lying face, said further profiled section component and support base being extruded together and having areas of contact therebetween, and said further profiled section component being joined metallically and mechanically as a surface layer to the support base during an extrusion process at the areas of contact therebetween, wherein said further profiled section component is a profiled strip of a metal different from the support base, wherein said further profiled section component including at least one projection extending from the further profiled section component which projects towards the support base, wherein the at least one projection is at least one of thermally and mechanically joined to the inner-lying face of said further profiled section component, wherein said at least one projection delimits at least one undercut space that is filled by metallic material of the support base, is interlocked with the support base and is embedded in the support base, and wherein said at least one projection is arranged such a way to allow the profiled strip containing said at least one projection to be coiled on a reel.

2. Composite according to claim 1, wherein said at least one projection includes at least one row of projections which project from the inner-lying face of the profiled strip between and a distance from its longitudinal edges.

3. Composite according to claim 1, wherein said at least one projection includes at least one channel-shaped section with flanges thereon, wherein its flanges are directed away from the inner-lying face of the profiled strip, wherein recesses are provided in the flanges and wherein the recesses define flange parts.

4. Composite according to claim 3, wherein the recesses define undercut spaces that are filled by metallic material of the support base.

5. Composite according to claim 3, wherein the flanges of the channel-shaped section run at an angle to the inner-lying face which is less than 90°.

6. Composite according to claim 1, wherein said at least one projection includes one wire or rod element which is attached to the profiled strip parallel to its longitudinal edges.

7. Composite according to claim 1, wherein said at least one projection includes bolts as means of anchorage which are attached to the profiled strip, wherein the bolts are blunted cone shaped and forming an undercut ring-shaped surface.

8. Composite according to claim 1, wherein bolts are secured to the inner-lying face of the further profiled section component.

* * * * *